US006633112B2

(12) United States Patent
Davies et al.

(10) Patent No.: US 6,633,112 B2
(45) Date of Patent: Oct. 14, 2003

(54) FILAMENT ARRAY FOR INCANDESCENT LAMP

(75) Inventors: Andrew Davies, Leicester (GB); Roger Alan Hume, Leicester (GB)

(73) Assignee: General Electric Company, Schenectady, NY (US)

( * ) Notice: Subject to any disclaimer, the term of this patent is extended or adjusted under 35 U.S.C. 154(b) by 21 days.

(21) Appl. No.: 09/873,663

(22) Filed: Jun. 4, 2001

(65) Prior Publication Data

US 2002/0017861 A1 Feb. 14, 2002

(51) Int. Cl.[7] ..... H01K 1/18; H01K 1/16

(52) U.S. Cl. ..... 313/273; 313/272; 313/316; 313/315

(58) Field of Search ..... 313/315, 316, 313/271–277, 578, 579, 341, 343, 344

(56) References Cited

U.S. PATENT DOCUMENTS

| | | | | |
|---|---|---|---|---|
| 2,006,820 A | * | 7/1935 | Adams | 313/44 |
| 2,288,499 A | * | 6/1942 | Van Horn | 313/273 |
| 3,622,832 A | * | 11/1971 | Schlessel et al. | 313/318.11 |
| 4,658,180 A | | 4/1987 | Ooms | |
| 4,743,802 A | | 5/1988 | Connor et al. | |
| 4,766,339 A | * | 8/1988 | Berry et al. | 313/276 |
| 4,897,573 A | * | 1/1990 | Ooms | 313/273 |
| 5,268,613 A | | 12/1993 | Cunningham | |

FOREIGN PATENT DOCUMENTS

| | | |
|---|---|---|
| EP | 0 418 950 A1 | 3/1991 |
| GB | 904284 | 8/1962 |
| WO | WO 93/01613 | 1/1993 |

* cited by examiner

*Primary Examiner*—Nimeshkumar D. Patel
*Assistant Examiner*—Karabi Guharay
(74) *Attorney, Agent, or Firm*—Fay, Sharpe, Fagan, Minnich & McKee, LLP

(57) ABSTRACT

A filament array for an incandescent lamp comprises at least five filament sections (10) having their longitudinal axes parallel with one another and, when viewed in plan, being arranged substantially symmetrically in a polygonal configuration around the lamp axis. The filament sections are wound from a single wire and are electrically connected together in series by means of linking sections (18, 19, 20) of said wire extending between corresponding ends of the filament sections, with alternate linking sections being positioned at opposite ends of the filament sections. The linking sections at the two ends of the array are supported by a set of support members (30, 31) extending from respective frame members (34, 35). The electrical input and output (14, 15) of the array are through terminal wire sections on opposite or substantially opposite sides of the array. The linking sections are configured such that said set of support members (30, 31) at each end of the array are substantially collinear, and said frame members (34, 35) each comprise a single straight member.

19 Claims, 3 Drawing Sheets

FILAMENT ARRAY FOR INCANDESCENT LAMP

BACKGROUND OF THE INVENTION

1. Field of the Invention

This invention relates generally to incandescent illumination systems, and particularly to a filament array for an incandescent lamp for use in combination with a concave reflector.

Incandescent lamps of this kind are typically used in theater, film, television, architectural and other general purpose lighting fixtures that provide high-intensity beams of light. It is desirable in such fixtures to collect as much of the light emitted by the lamp as possible, and project that light forward in a high-intensity beam.

2. Discussion of the Art

One commercial embodiment of a system of this type, known commercially as the "Source Four" system, is described in U.S. Pat. No. 5,268,613. In this system, a high intensity beam is generated using a filament with a multiplicity of helically-wound coils arranged in a substantially symmetrical pattern around the longitudinal axis of the lamp. There are two main commercial embodiments of this invention, which necessarily differ because of the demands of the voltage supply to the lamp. Lamps designed for operation on 115 V or 120 V supplies typically have four coils which, when viewed in plan, are arranged in a substantially square pattern around the longitudinal axis of the lamp, whereas lamps designed for operation at voltages between 220 V and 240 V typically have six coils which, when viewed in plan, are arranged in a substantially hexagonal pattern around the longitudinal axis of the lamp.

It is well understood amongst those skilled in the art, and has become even more apparent since the Source Four system was first commercialized, that the proportion of light collected by the reflector and projected forward into the beam could be substantially increased if the overall space occupied by the filament structure could be minimized. This has been achieved in the case of lamps designed for operation at 115 V and 120 V through the implementation of better control procedures in manufacturing and the use of arc-preventing gas fills in the lamp capsule. However, it has been found that the six-filament structures used at higher voltages, typically 220 V–240 V, become less reliable when made more compact in their existing form because the resulting high voltage gradient between the current-carrying wires leads to a high risk of arcing. Attempts have been made to overcome this by re-arranging the order in which the filament sections are joined together in series. However, this has necessitated the use of complex support structures which are difficult (and often costly) to manufacture on a consistent basis. Furthermore, such structures involve the precise placement of filament support hooks in 3-dimensional space in order to achieve the desired filament geometry. Any deviation from this precise placement requirement can have two detrimental effects. Firstly, the quality of the output of the lamp in its fixture is adversely affected, and secondly, there is an opportunity for sections of the filament and its support structure to be accidentally positioned too close to other sections of the same structure. In these cases, the lamp becomes susceptible to arc-out when it is subjected to vibrations in service. Hence the incidences of premature failure may be significantly increased.

It would be desirable, therefore, to link the filament sections together in such a way as to eliminate arcing, while at the same time simplifying the support structure for the filament support hooks.

BRIEF SUMMARY OF THE INVENTION

According to the present invention, there is provided a filament array for an incandescent lamp comprising at least five filament sections having their longitudinal axes parallel with one another and, when viewed in plan, being arranged substantially symmetrically in a polygonal configuration around the lamp axis; the filament sections being wound from a single wire and being electrically connected together in series by means of linking sections of said wire extending between corresponding ends of the filament sections, with alternate linking sections being positioned at opposite ends of the filament sections; the linking sections at the two ends of the array being supported by a set of support members extending from respective frame members; and with the electrical input and output of the array being through terminal wire sections on opposite or substantially opposite sides of the array; characterized in that the linking sections are configured such that said set of support members at each end of the array are substantially collinear, and said frame members each comprise a single straight member.

The present invention is suitably incorporated in an incandescent lamp adapted for use with a concave reflector to produce a high-intensity beam of light. The incandescent lamp comprises a plurality of linear, helically-wound filament sections which, when viewed in plan, are arranged with their longitudinal axes substantially parallel with each other, and arranged in a substantially symmetrical pattern in a polygonal configuration around the longitudinal axis of the lamp. The filament sections are electrically linked together in series. Each section is linked to an adjacent section by means of a linking section, referred to in the art as a loop. The filament structure may comprise loops of three or more different lengths.

The filament structure of the invention comprises a more compact filament than is currently available, and can be mounted onto its support frame in a simplified way without the need for the complex positioning of the hooks in 3-dimensional space, thus eliminating the risk of hot shock and early life arcing.

DETAILED DESCRIPTION OF THE INVENTION

Figure 1:
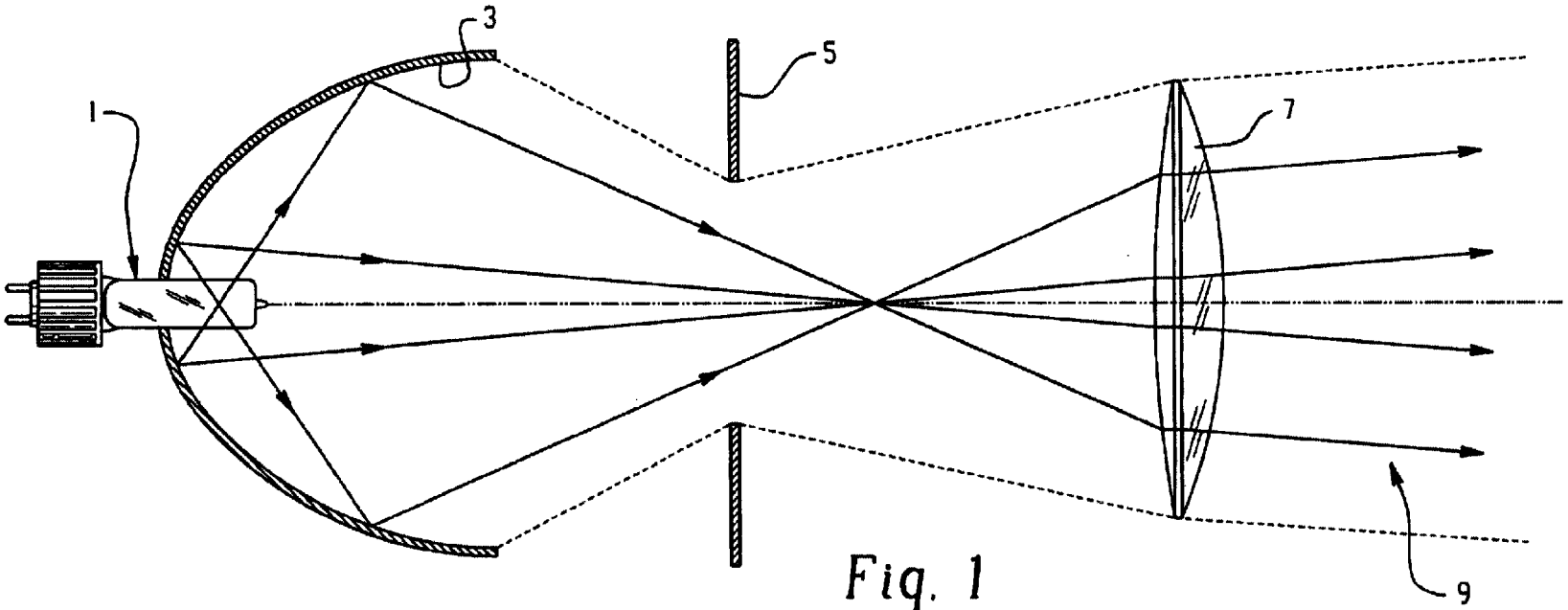
Fig. 1 PRIOR ART
FIG. 1 is a schematic view of a known lamp system of the kind disclosed in U.S. Pat. No. 5,268,613.
Figure 2:
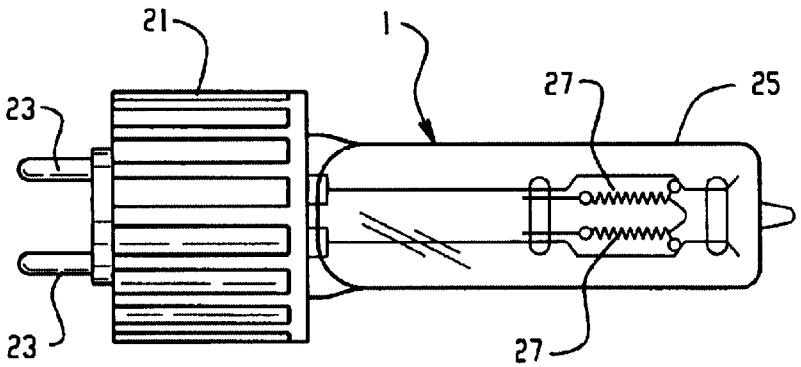
Fig. 2 PRIOR ART
FIG. 2 is a schematic side view of a known lamp having four filament sections suitable for use in the system of FIG. 1.
Figure 3:
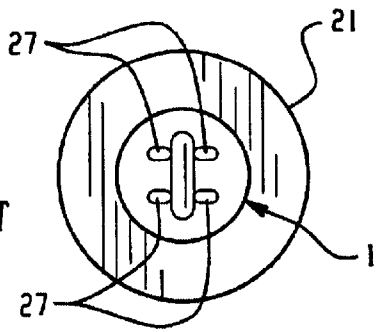
Fig. 3 PRIOR ART
FIG. 3 is a plan view of the known lamp of FIG. 2.

Referring first to FIGS. 1 to 3, there is shown a typical arrangement for a high efficiency illumination system employing an incandescent lamp with a filament array comprising four filament sections. This arrangement includes an incandescent lamp 1, a concave (ellipsoidal) reflector 3, an aperture 5 and a lens 7. This provides a concentrated beam of light 9 which is emitted in a direction along the axis of the lamp and the reflector.

A typical incandescent lamp used with this system is shown in FIGS. 2 and 3 and comprises a base 21 with connectors 23 and a glass or quartz bulb 25. Inside the bulb are arranged four filament sections 27 which are arranged in two offset rows of two filament sections.

Figure 4:
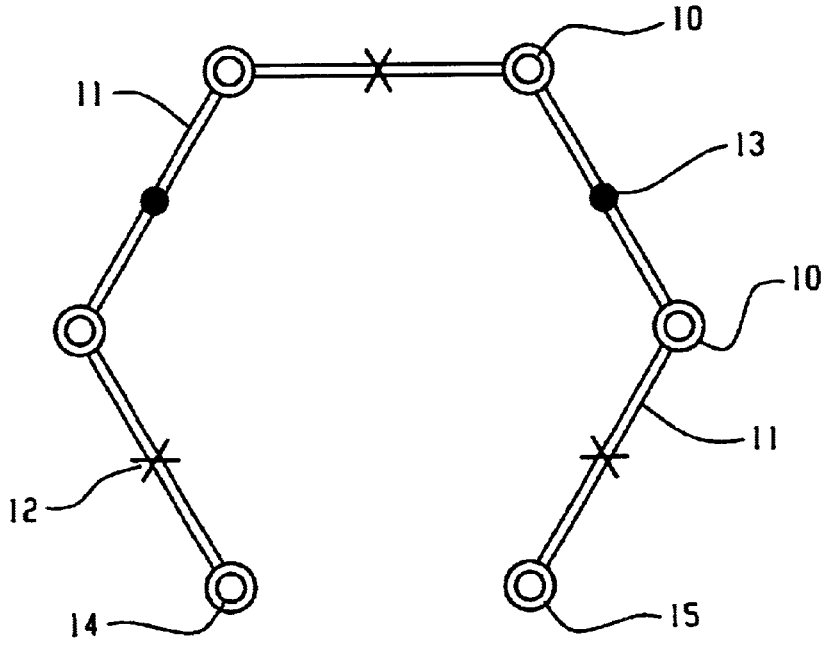
Fig. 4 PRIOR ART
FIGS. 4 and 5 are schematic plan views of known filament arrays having six filament sections.

Referring to FIG. 4, there is shown a plan view of a commonly-used method of linking together filament sections in a widely available lamp of the type covered by U.S. Pat. No. 5,268,613. It can be seen that the arrangement of the filament sections 10 (indicated by double concentric circles) is such that they lie in a substantially hexagonal pattern, when viewed in plan, and are linked by five connecting loops 11 of approximately equal size (indicated schematically by straight lines). The points at which the loops are supported by hooks are marked by crosses and dots 12, 13. A cross 12 means that the hook is supported from above the filament sections, while a dot 13 means that it is supported from below. (Of course these could be interchanged to produce an equivalent, but inverted, arrangement.) The filament has connection terminals 14, 15 across which the full supply voltage is applied. It will be understood by those skilled in the art, and familiar with lamps of this type, that the distance between these terminals limits the degree to which the array can be compressed, because of the risk of arcing between them.

Figure 5:
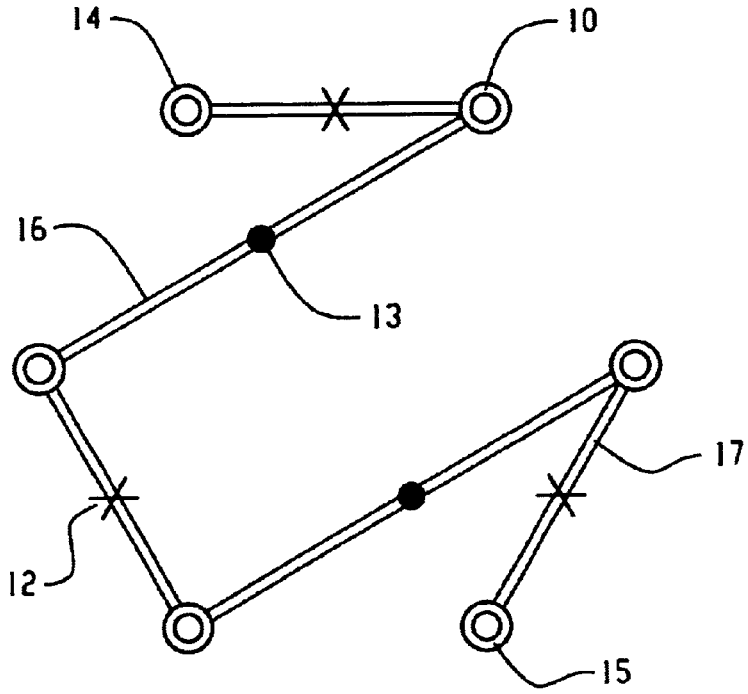
Fig. 5 PRIOR ART

FIG. 5 depicts a method of linking together filament sections used in commercial lamps recently launched into the marketplace. Again, crosses and dots are used to indicate the points at which the loops are supported by hooks. It will be seen that there are two different lengths of loop 16, 17, as opposed to a single length in FIG. 4. This arrangement is preferable to that shown in FIG. 4 in that the distance between the two connection terminals 14, 15 is significantly increased. This means that the risk of arcing between the terminals is significantly reduced when compared to the array shown in FIG. 4. Thus, the overall cross-sectional area occupied by the array may be reduced with the resultant advantage of improved luminaire efficiency. However, this method of linking the filament sections together is difficult to control in practice. It is also extremely difficult to place the supporting hooks accurately and consistently when mounting the filament onto the frame. These manufacturing difficulties restrict the degree to which the filament size can be compressed because of the risk of hot shock.

Figure 6:
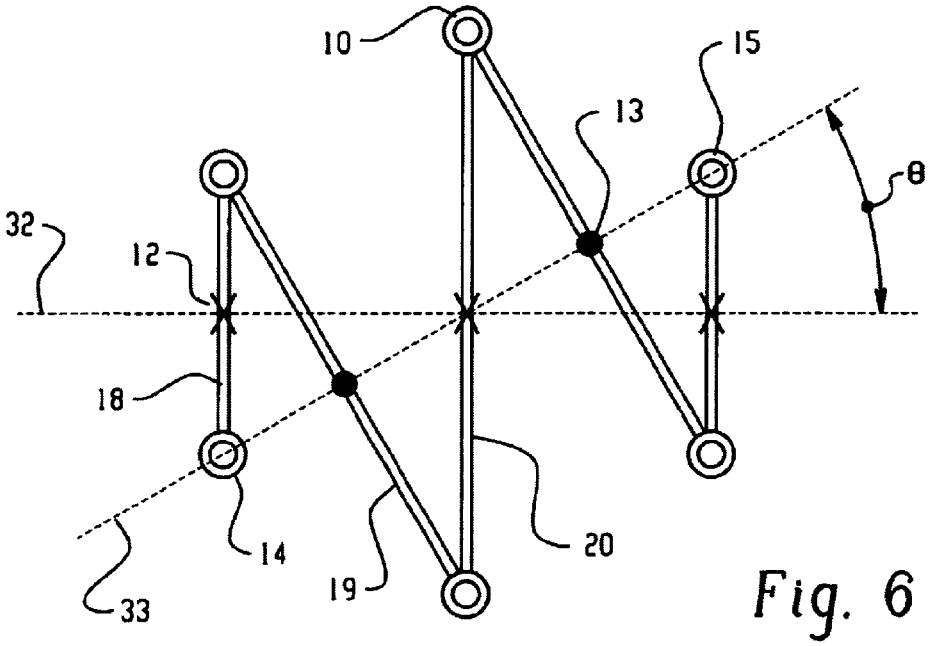
FIG. 6 is a schematic plan view of a filament array having six filament sections in accordance with the invention.
Figure 7:
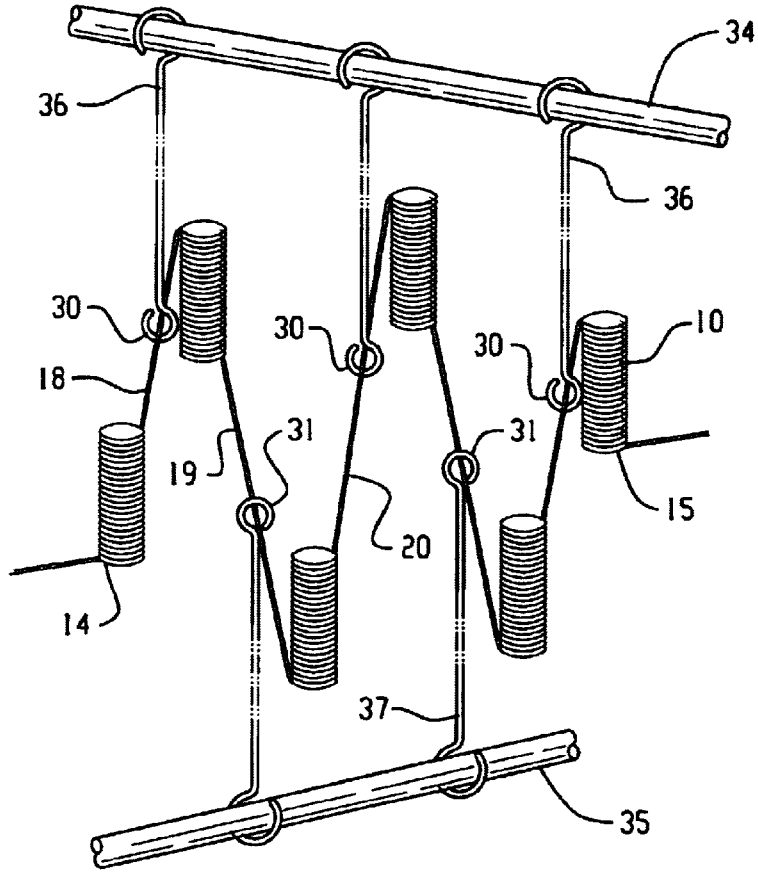
FIG. 7 is a partly exploded perspective view of the filament array shown in FIG. 6.

FIGS. 6 and 7 illustrate the method of linking together six filament sections in accordance with the present invention, the filament sections, when viewed in plan, forming a hexagon. The same notation for filament sections, loops, support hook positions and terminals is used as in FIGS. 4 and 5. It will be seen that three distinct lengths 18, 19 and 20 of loop are used, linking the sections together in a zig-zag pattern. With this arrangement, the advantage of the maximized distance between the connection terminals 14, 15 shown in FIG. 5 is maintained. Alternating hooks 30, 31 are positioned in two straight lines, indicated by dashed and dotted lines 32, 33 respectively. These two lines are inclined relative to each other at an angle θ. The hooks support the loops 18, 19 and 20 substantially midway between the filament sections. Upper and lower frames 34, 35 to which the hooks 30, 31 are secured are single, straight rods of insulating material, typically of quartz. Other materials may also be used, such as glass or ceramic materials which are suitable as insulators and which are suitably inert under lamp operating conditions. The two frames are secured in well known fashion within a lamp envelope, above and below the filament array, and in the embodiment shown in FIG. 7 are inclined to one another at the angle θ. In this case, the wires 36, 37 extending from the hooks, 30, 31 to the respective frames 34, 35 are substantially parallel with the longitudinal axis of the filament array. The frames 34, 35 may alternatively be positioned such that they make an angle with each other which is not the same as the angle θ between the two collinear arrangements of hooks 30, 31. In these circumstances, either or both of the sets of wires 36, 37 may be non-parallel with the filament axis. For example, either the upper frame 34 or the lower frame 35 may be rotated, compared with its position shown in FIG. 7, to make it parallel with the other frame. In another convenient arrangement, both frames 34 and 35 may be rotated until they are parallel with one another and positioned along a line bisecting the angle θ. These alternative arrangements thus allow the two frames 34, 35 to be parallel with one another, with the last described arrangement requiring the least inclination of the wires 36, 37 to the lamp axis. Such collinear arrangements of support hooks are simple to manufacture consistently on standard factory equipment, and do not require subsequent accurate positioning either manually or using specialized automated systems. This, combined with the relatively large distance between the connection terminals, means that the factors restricting the degree of compression of filament size which exist in the aforementioned two cases do not exist in this case. Therefore, this arrangement facilitates more compact array sizes, and hence more efficient illumination systems, than could hitherto be achieved.

The preferred embodiment of this invention is the 6-section filament in the hexagonal configuration described above. However, the invention is equally applicable for embodiments which use five filament sections or more than six, and in which the filament sections, when viewed in plan, form a regular polygon. More specifically, in arrangements using an even number of filament sections, such as 6, 8 or 10, there will be an odd number of hooks (corresponding to the odd number of loops connecting together the filament sections). In such cases there will be two collinear arrays of hooks containing unequal numbers of hooks; for example with six filament sections, there will be two and three hooks respectively at opposite ends of the filament array. Similarly, with eight filament sections, there will be three and four hooks respectively at opposite ends of the filament array. For arrangements with an odd number of filament sections, such as 5, 7 or 9, an even number of hooks (i.e. 4, 6, or 8 hooks respectively) are needed, with equal numbers of hooks at each end of the array.

Preferably, the sections of the filament should be arranged such that the spacing between them is as small as possible without causing a significant risk of arcing. This may be facilitated by adding hydrogen to the gas inside the glass or quartz bulb surrounding the filament, as described in U.S. Pat. No. 4,743,802, owned by GE.

The preferred application of filament arrays of the type described in this invention is in lamps with a concave reflector, with the longitudinal axis of the lamp coinciding with the longitudinal axis of the reflector. In order to maximise the amount of light collected by the reflector, it is preferable for the axial length of the filament to be as small as possible, and for the centroid of the filament array to lie at the focal point of the reflector. The reflector is preferably part of a separate fixture into which the lamp is fitted, but it is also possible to envisage an embodiment of this invention used in a lamp where the reflector is an integral part the lamp.

The invention has been described with reference to the exemplary embodiment. Modifications and alterations will occur to others upon reading and understanding this specification. The invention is intended to include such modifications and alterations in so far as they come within the scope of the appended claims or the equivalents thereof.

What is claimed is:

1. A filament array for an incandescent lamp comprising:

at least five filament sections having their longitudinal axes parallel with one another and, when viewed in plan, being arranged substantially symmetrically in a polygonal configuration around the lamp axis;

the filament sections being wound from a single wire and being electrically connected together in series by means of linking sections of said wire extending between corresponding ends of the filament sections, with alternate linking sections being positioned at opposite ends of the filament sections;

the linking sections at ends of the array being supported by a set of support members extending from respective frame members;

with electrical input and output of the array being through terminal wire sections on opposite or substantially opposite sides of the array; and the linking sections being configured such that said set of support members at each end of the array are substantially collinear, and said frame members each comprise a single straight member;

the support members support the linking members substantially midway between filament sections, and the lines of support members at opposite ends of the filament array are inclined at an angle to one another;

the frame members are aligned parallel with their respective support members so as to be inclined to one another at the same angle as the angle between the support members.

2. The filament array of claim 1 in which the support members are wire hooks and the frame members are rods of an insulating material.

3. The filament array of claim 1 wherein the total number of filament sections is six.

4. An incandescent lamp having a lamp axis extending therealong, the lamp comprising:

a filament array having at least five filament sections where the filament sections are disposed in parallel relation to one another and extend between axially opposed array ends, the filament array defining a substantially symmetrical polygon when viewed in plan, the filament sections connected together in series by wire linking sections with each linking section extending from one end of one filament section to the opposite end of an adjacent filament section;

a plurality of support members each extending from one of two spaced-apart frame members for supporting the filament array by the linking sections thereof, the linking sections are configured so that the support members extending toward each respective array end attach to the filament array along a substantially straight line when viewed in plan forming a first and a second attachment line each corresponding to a different array end such that the support members are substantially collinear, the first and second attachment lines are oriented at an angle $\theta$ relative to one another, and the frame members each comprise a straight member and are oriented relative to one another at substantially the same angle $\theta$ as the first and second attachment lines.

5. The incandescent lamp of claim 4, wherein all of said filament sections and said linking sections are together formed from a continuous length of filament wire.

6. The incandescent lamp of claim 4, wherein said support members are wire books.

7. The incandescent lamp of claim 4, wherein said frame members are rods of an insulating material.

8. The incandescent lamp of claim 4, wherein the filament array has two opposing terminal ends and a maximum dimension extending across the array when viewed in plan, and the dimension extending across the two terminals is substantially equal to the maximum dimension across the array.

9. The incandescent lamp of claim 4, wherein each of said support members supports said filament array along a different one of said linking sections substantially at a respective midpoint thereof.

10. The incandescent lamp of claim 4, wherein said filament array has a line extending thereacross when viewed in plan, and each linking section extends across said line.

11. A filament array for an incandescent lamp having a lamp axis, said filament array comprising:

a first and a second frame member each supported within said incandescent lamp axially spaced apart from one another;

at least five filament sections and a corresponding number of linking sections electrically connecting said filament sections in series, said filament sections being arranged substantially symmetrically in a polygonal configuration around said lamp axis;

said filament sections are supported between said first and said second frame members by a first set of support members extending between a first group of said linking sections and said first frame member and by a second set of support members extending between a second group of said linking sections and said second frame member;

said first set of support members engaging one or more of said linking sections substantially along a first line extending across said array when viewed in plan and said second set of support members engaging one or more of said linking sections substantially along a second line extending across said array when viewed in plan, said first and said second lines are disposed relative to one another at an angle θ; and, said first and second frame members are disposed relative to one another when viewed in plan at substantially the same angle θ as said first and second lines.

12. The filament array of claim 11, wherein said first frame member is disposed substantially parallel to said first line of said first set of support members, and said second frame member is disposed substantially parallel to said second line of said second set of support members.

13. The filament array of claim 11, wherein all of said filament sections and said linking sections are together formed from a continuous length of filament wire.

14. The filament array of claim 11, wherein said support members of each of said first and second sets are wire hooks.

15. The filament array of claim 11, wherein said frame members are rods of an insulating material.

16. The filament array of claim 11, wherein the filament array has two opposing terminal ends and a maximum dimension extending across the array plan, and the dimension extending across the two terminals is substantially equal to the maximum dimension across the array.

17. The filament array of claim 11, wherein each of said support members supports said filament array along a different one of said linking sections.

18. The filament array of claim 11, wherein each of said support members supports said filament array substantially at a midpoint of one of said linking sections.

19. The filament array of claim 11, wherein each of said linking sections extends across said first line when viewed in plan.

* * * * *